US009592673B2

(12) United States Patent
Sato et al.

(10) Patent No.: US 9,592,673 B2
(45) Date of Patent: Mar. 14, 2017

(54) MAINTENANCE DEVICE AND LIQUID EJECTING APPARATUS

(71) Applicant: SEIKO EPSON CORPORATION, Tokyo (JP)

(72) Inventors: Seiya Sato, Matsumoto (JP); Ryoji Fujimori, Suwa (JP); Shion Kubomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/093,902

(22) Filed: Apr. 8, 2016

(65) Prior Publication Data

US 2016/0339710 A1 Nov. 24, 2016

(30) Foreign Application Priority Data

May 20, 2015 (JP) ..... 2015-102526

(51) Int. Cl.
*B41J 2/165* (2006.01)

(52) U.S. Cl.
CPC ..... *B41J 2/16544* (2013.01)

(58) Field of Classification Search
CPC ..... B41J 2/16544
See application file for complete search history.

(56) References Cited

U.S. PATENT DOCUMENTS

2005/0146553 A1* 7/2005 Lim ..... B41J 2/16547 347/33
2013/0162707 A1* 6/2013 Kitaoka ..... B41J 2/135 347/9

FOREIGN PATENT DOCUMENTS

JP 06-143597 A 5/1994
JP 4371547 B 9/2009

* cited by examiner

*Primary Examiner* — Stephen Meier
*Assistant Examiner* — Alexander D Shenderov
(74) *Attorney, Agent, or Firm* — Workman Nydegger

(57) ABSTRACT

A maintenance device includes a wiper that wipes a liquid ejecting unit; a double rack member which includes a rack sections made up of a first rack section and a second rack section and is configured to reciprocate the wiper; and an intermittent gear which includes a teeth portion which meshes with one of the two rack sections and a toothless portion which is arranged in line with the teeth portion in a rotation direction, wherein the double rack member allows the wiper to perform a forward motion when the first rack section meshes with the intermittent gear, and allows the wiper to perform a backward motion when the second rack section meshes with the intermittent gear.

6 Claims, 13 Drawing Sheets

MAINTENANCE DEVICE AND LIQUID EJECTING APPARATUS

BACKGROUND

1. Technical Field

The present invention relates to maintenance devices that perform maintenance of a liquid ejecting unit and liquid ejecting apparatuses.

2. Related Art

As described in JP-A-6-143597, there is a type of maintenance device for a liquid ejecting apparatus such as an ink jet printer which has a wiper that is configured to wipe over a liquid ejecting unit so as to perform a wiping operation for removing a foreign substance attached on the liquid ejecting unit.

When a motor is used as a drive source that reciprocates the wiper for allowing the wiper to perform a forward motion by rotation of the motor in one direction and allowing the wiper to perform a backward motion by rotation of the motor in the other direction, the rotation direction of the motor needs to be switched to change the moving direction, which causes a problem of complicated control of the motor.

Further, such a problem exists not only in ink jet printers, but also in maintenance devices that perform a wiping operation by reciprocating the wiper.

SUMMARY

An advantage of some aspects of the invention is to provide a maintenance device that can reciprocate a wiper without switching a driving direction of a drive source and provide a liquid ejecting apparatus.

A solution for the above problem and the operation and effect of the solution will be described below. A maintenance device for solving the above problem includes a wiper that wipes a liquid ejecting unit, a double rack member which includes a pair of rack sections made up of a first rack section and a second rack section and is configured to reciprocate the wiper, and an intermittent gear which includes a teeth portion which meshes with one of two paired rack sections during rotation in one direction and a toothless portion which is arranged in line with the teeth portion in a rotation direction, wherein the double rack member allows the wiper to perform a forward motion when the first rack section meshes with the intermittent gear, and allows the wiper to perform a backward motion when the second rack section meshes with the intermittent gear.

With this configuration, when the intermittent gear rotates in one direction by a predetermined rotation angle while the teeth portion of the intermittent gear engages with the first rack section of the double rack member, the wipers perform a forward motion. Then, when the intermittent gear rotates in the one direction, the teeth portion of the intermittent gear engages with the second rack section of the double rack member, and when the intermittent gear further rotates in the one direction, the wipers perform a backward motion. That is, since the wipers reciprocate with the rotation of the intermittent gear in one direction, the wipers can reciprocate without switching the drive direction of the drive source that rotates the intermittent gear.

In the above maintenance device, the intermittent gear may include a projection that extends in the rotation direction as part of the toothless portion, and, after one of the two rack sections disengages from the teeth portion, the projection may come into contact with the one rack section before the teeth portion engages with the other rack section.

While the wipers move with the teeth portion of the intermittent gear engaging with the rack sections, the double rack member is pushed by the teeth portion via the rack sections. Accordingly, it does not move in the opposite direction of the moving direction. However, during the period from when the teeth portion of the intermittent gear moves away from one rack section to when it engages with the other rack section, there is a risk that the double rack member unintentionally moves due to an external force since it is not in contact with the teeth portion. In the above configuration, however, after the teeth portion of the intermittent gear disengages from one rack section, the projection which is part of the toothless portion comes into contact with the disengaged rack section, thereby preventing unnecessary movement of the double rack member. Accordingly, the double rack member can remain in position until the teeth portion of the intermittent gear engages with the other rack section so that the teeth portion of the intermittent gear appropriately engages the other rack section.

In the above maintenance device, the intermittent gear may move away from the one rack section at a timing when the teeth portion starts to engage with the other rack section. With this configuration, after the teeth portion of the intermittent gear moves away from one rack section, the projection of the toothless portion comes into contact with the one rack section to prevent unnecessary movement of the double rack member. The projection of the toothless portion moves away from the one rack section at a timing when the teeth portion of the intermittent gear starts to engage with the other rack section. Accordingly, when the teeth portion of the intermittent gear engages with the other rack section, the double rack member is allowed to move by rotation of the intermittent gear.

In the above maintenance device, the rack section may include a first engaging part located on a downstream end in a moving direction of the double rack member, and a second engaging part located adjacent to the first engaging part in the moving direction, the teeth portion of the intermittent gear may include a first tooth that engages with the first engaging part and a second tooth that engages with the second engaging part, and the second engaging part may be disposed at a position which does not mesh with the first tooth when the intermittent gear meshes with the rack section.

With this configuration, while the first engaging part and the second engaging part of the rack sections with which the first tooth and the second tooth of the intermittent gear engage, respectively, are aligned in the moving direction of the double rack member, the second engaging part is disposed at a position that does not engage with the first tooth. As a result, when the intermittent gear rotates in one direction, the first tooth does not engage with the second engaging part and engages with the first engaging part which is located further downstream in the moving direction. Accordingly, even if the double rack member is unintentionally displaced downstream in the moving direction when the intermittent gear does not engage with the rack sections, the first tooth does not engage with the second engaging part, thereby preventing occurrence of deviation in engagement between the intermittent gear and the rack sections.

The above maintenance device may further include a composite gear which includes a small diameter gear and a large diameter gear having a larger number of teeth than the small diameter gear, and a long rack member which includes a long rack section that is configured to mesh with the large diameter gear and which holds the wiper, wherein the double rack member includes a short rack section that is configured to mesh with the small diameter gear.

With this configuration, when the double rack member moves by rotation of the intermittent gear, the small diameter gear which engages with the short rack section of the double rack member rotates, thereby rotating the large diameter gear of the composite gear. Accordingly, the wipers moves along with the long rack member which includes the long rack section that engages with the large diameter gear. Since the large diameter gear that moves the long rack member has a larger number of teeth than the small diameter gear that rotates by movement of the double rack member, the moving distance of the long rack member can be larger than the moving distance of the double rack member. Accordingly, the moving distance of the wipers can be increased depending on the size and position of an area to be wiped in the liquid ejecting unit.

A liquid ejecting apparatus for solving the above problem includes a liquid ejecting unit that is configured to eject liquid, and the above maintenance device. With this configuration, the same operation and effect as that of the above maintenance device can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus will be described. A liquid ejecting apparatus is an ink jet printer that performs recording (printing) by ejecting ink, which is an example of liquid, onto a medium such as a sheet of paper.

Figure 1:
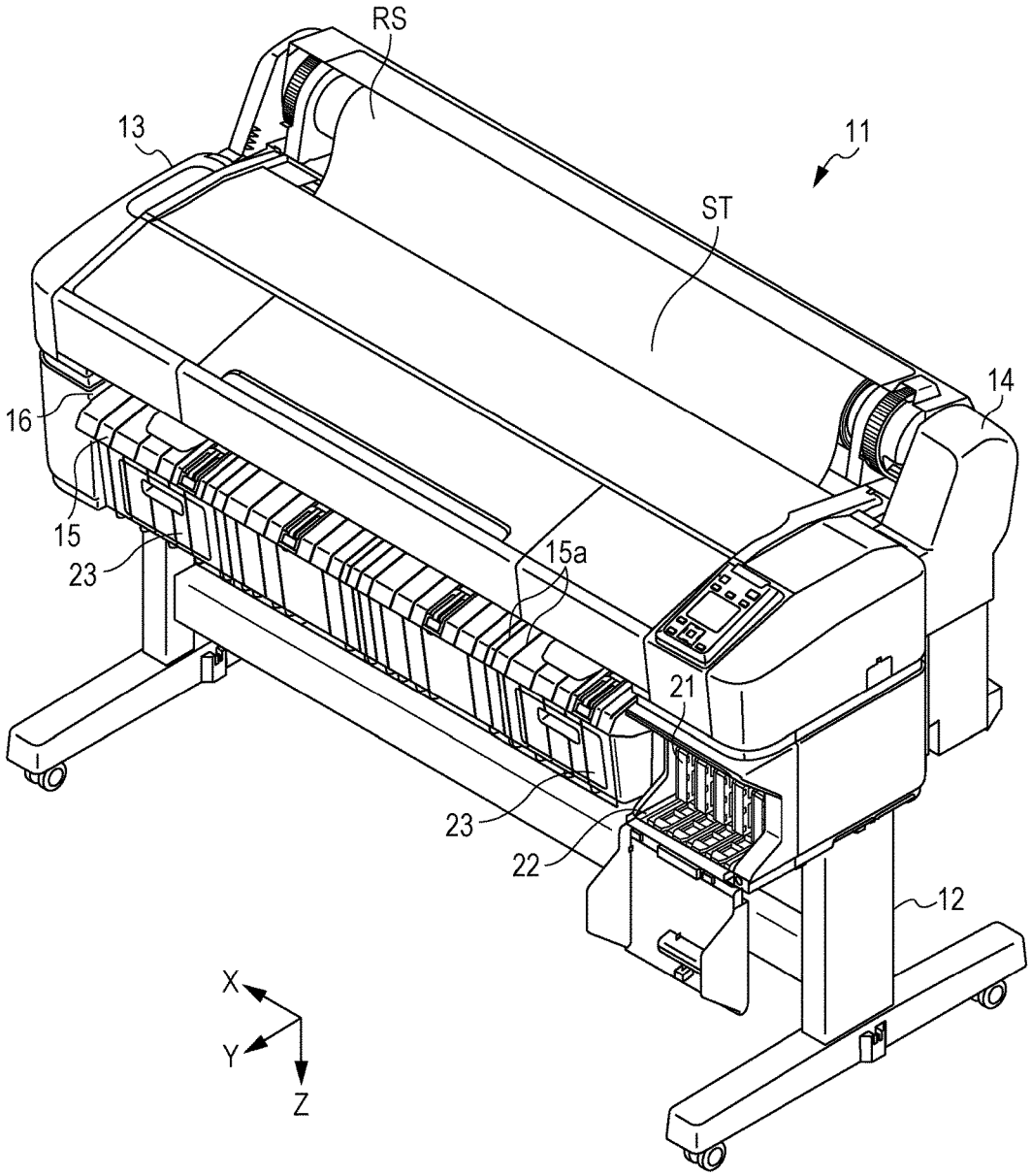
FIG. 1 is a perspective view which shows an embodiment of a liquid ejecting apparatus.

As shown in FIG. 1, a liquid ejecting apparatus 11 of the present embodiment includes legs 12, a main body 13 in a substantially cuboid shape supported by the legs 12, and a feeding unit 14 that feeds a medium ST to the main body 13. The feeding unit 14 rotatably holds a roll RS made up of the medium ST wound into the form of roll so that the feeding unit 14 rotates the roll RS to unwind and feed the medium ST into the main body 13.

The main body 13 includes a support member 15 that supports the medium ST in the main body 13 when the medium ST is fed out from the feeding unit 14 located on the back side of the main body 13. Further, an output port 16 is open to the front surface of the main body 13 through which the medium ST supported by the support member 15 is fed out of the main body 13. A plurality of ribs 15*a* are formed on the upper surface of the support member 15 in a scan direction X so as to support the medium ST.

In the present embodiment, a direction extending in a longitudinal direction of the main body 13 is referred to as the scan direction X, and a direction in which the medium ST is transported on the support member 15 is referred to as a transfer direction Y. Further, the scan direction X and the transfer direction Y intersect with each other (for example, perpendicularly), and both the scan direction X and the transfer direction Y intersect with a gravitational direction Z (for example, perpendicularly).

A container holding unit 22 is disposed on one end in the scan direction X of the main body 13 so that a plurality of liquid containers 21 that contain ink, which is an example of liquid are detachably mounted in the container holding unit 22. A plurality of (in this embodiment, four) liquid containers 21 are provided corresponding to the respective types (colors) of liquid. The number and size of the liquid containers 21 housed in the container holding unit 22 may be appropriately modified. Alternatively, an inlet hole may be formed on the liquid container 21 for replenishing liquid therethrough or for supplying liquid from the outside via a supplying tube connected to the inlet hole during printing.

In the scan direction X, an end on which the container holding unit 22 of the main body 13 is located is referred to as a home end, while the opposite end is referred to as a non-home end. The container holding unit 22 may also be disposed on the non-home end. Further, a plurality of (for example, two) waste liquid container mounting sections 23 are disposed at positions close to the both ends in the scan direction X on the vertically lower side of the support member 15.

Figure 2:
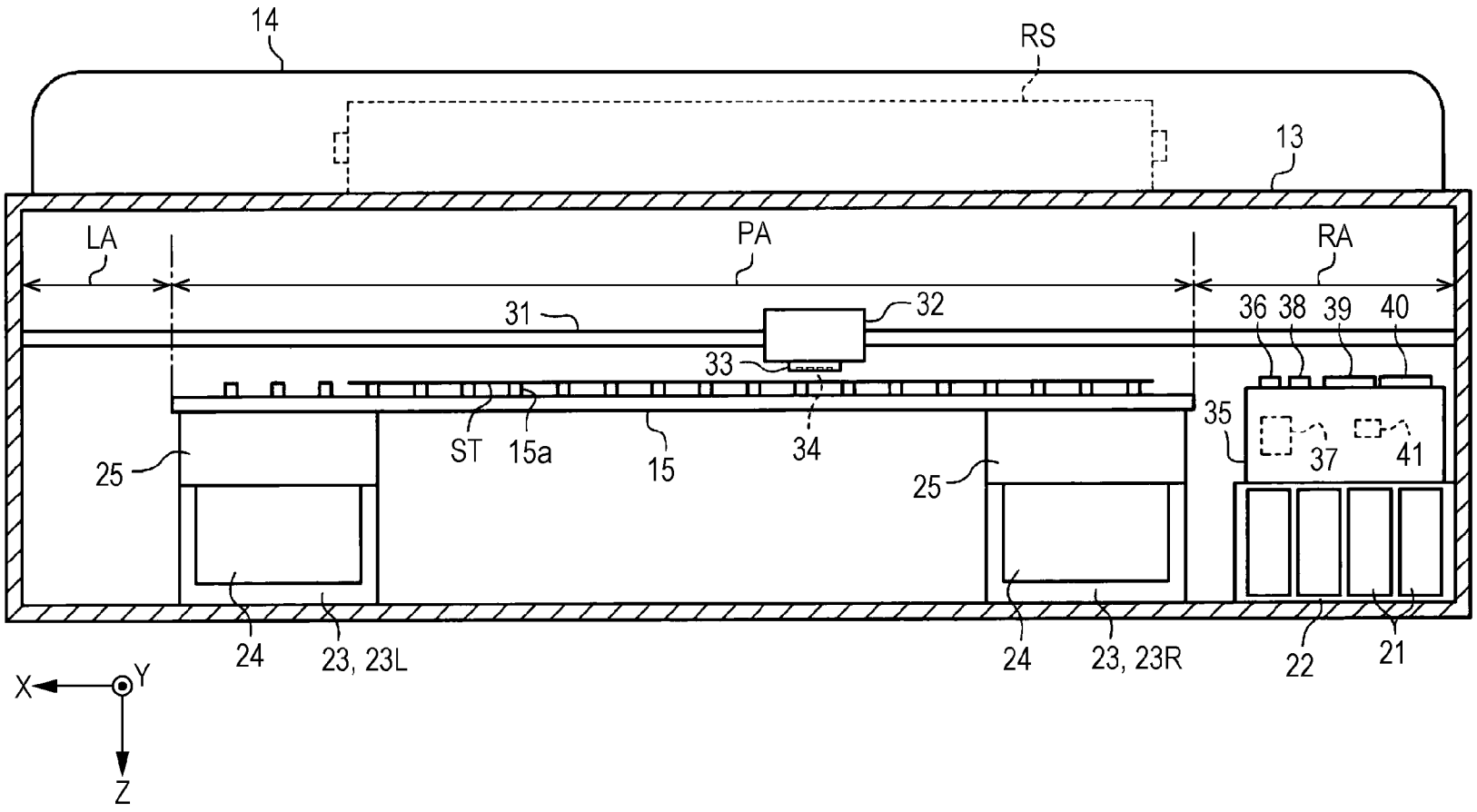
FIG. 2 is a cross sectional view which shows a schematic configuration of the liquid ejecting apparatus.

As shown in FIG. 2, the liquid ejecting apparatus 11 includes a guide shaft 31 which extends in the scan direction X in the main body 13, a carriage 32 held by the guide shaft 31, and a liquid ejecting unit 33 held by the carriage 32. The liquid ejecting unit 33 includes a plurality of nozzles 34 capable of ejecting liquid. The liquid containers 21 are mounted in the container holding unit 22 so that liquid in the liquid containers 21 is supplied to the liquid ejecting unit 33 via a supplying mechanism, which is not shown in the figure. The liquid ejecting unit 33 ejects the supplied liquid from the nozzles 34 onto the medium ST, thereby performing printing (recording).

Waste liquid containers 24 are detachably mounted in the waste liquid container mounting sections 23 (23R, 23L) so that liquid discharged as waste liquid from the liquid ejecting unit 33 is stored in the waste liquid container mounting sections 23. For example, when borderless printing which does not remain a margin on the edge of the medium ST is performed, the liquid overflowed from the medium ST is received in a portion of the support member 15 which does not have a rib 15*a* and is stored in the waste liquid containers 24 mounted in the waste liquid container mounting sections 23 via waste liquid introduction units 25 which are provided on the vertically upper side of the waste liquid container mounting sections 23.

In the moving area of the liquid ejecting unit 33 in the scan direction X, an area in which the support member 15 is provided is referred to as a printing area PA, while areas outside the printing area PA are referred to as non-printing areas RA, LA. The waste liquid container mounting sections 23 are disposed at a position that corresponds to the printing area PA, and the container holding unit 22 is disposed at a position that corresponds to the non-printing area RA.

The liquid ejecting apparatus 11 further includes a maintenance device 35 that performs maintenance of the liquid ejecting unit 33. The maintenance device 35 includes a suction cap 36 and a suction pump 37 which are disposed, for example, in the non-printing area RA so as to suction and discharge liquid from the nozzles 34 of the liquid ejecting unit 33, a wiping unit 38 that wipes the liquid ejecting unit 33, a flushing unit 39, a moisture retention cap 40, and a drive source 41.

The drive source 41 is, for example, one or a plurality of motors for operating components of the maintenance device 35. The suction cap 36 and the moisture retention cap 40 are configured to be relatively movable to the liquid ejecting unit 33. As they relatively move toward the liquid ejecting unit 33, a capping operation is performed while a closed space is formed by the openings of the nozzles 34. Then, the moisture retention cap 40 prevents the nozzles 34 from being dried by during the capping operation.

When the liquid ejecting apparatus 11 does not perform printing, the liquid ejecting unit 33 stands-by at a position which corresponds to the moisture retention cap 40 with being capped by the moisture retention cap 40. Accordingly, a position at which the moisture retention cap 40 is located in the scan direction X is referred to as a home position of the liquid ejecting unit 33. That is, in the scan direction X of the liquid ejecting unit 33, the side on which the moisture retention cap 40 is located with respect to the printing area PA is referred to as a home position side.

When the suction pump 37 is actuated while the suction cap 36 is in a capping state, a negative pressure is applied to the closed space formed between the suction cap 36 and the liquid ejecting unit 33 so that suction cleaning is performed in which liquid is suctioned and discharged from the nozzles 34 by means of the negative pressure. The liquid discharged from the nozzles 34 during suction cleaning is stored in the waste liquid containers 24 as waste liquid.

Figure 3:
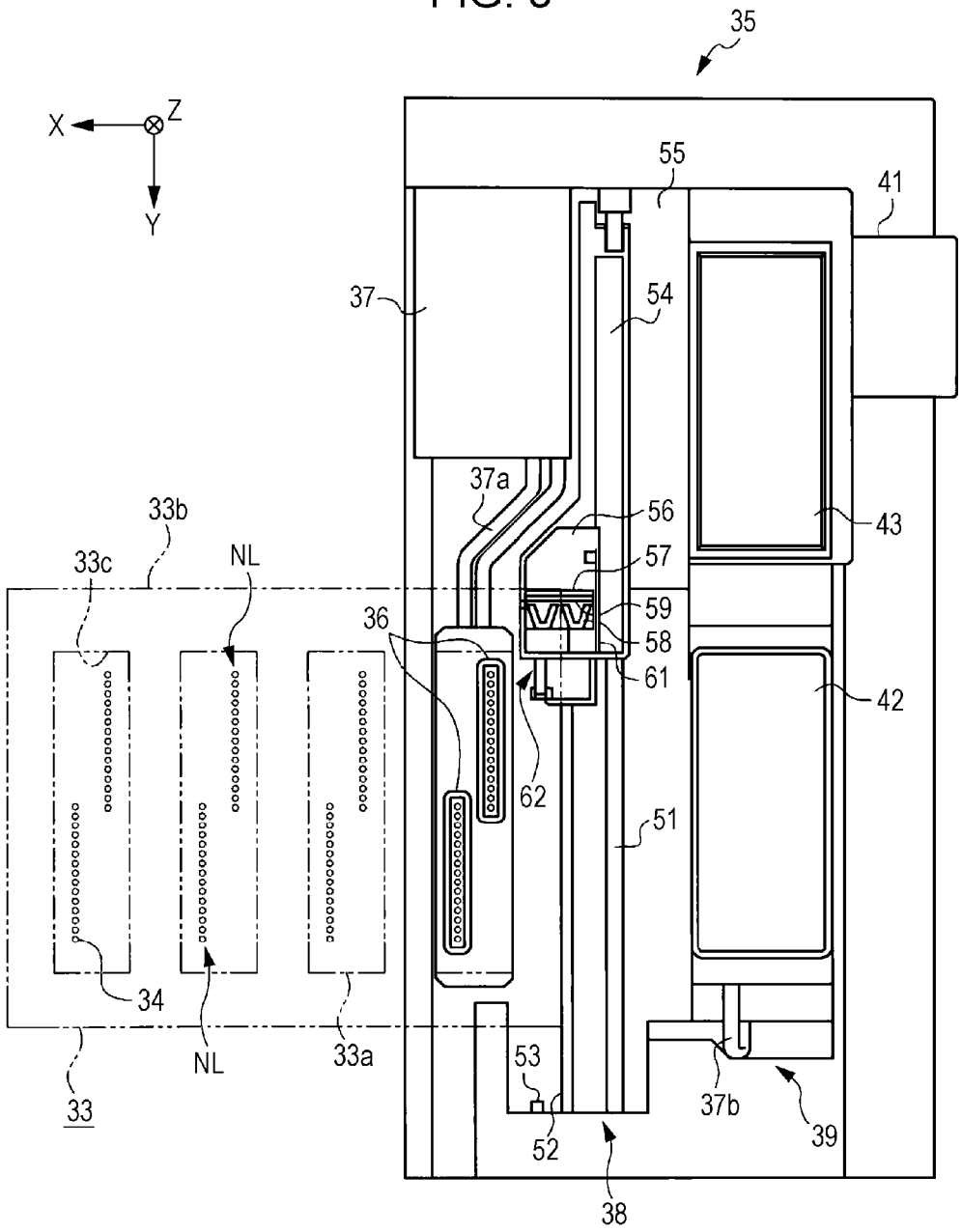
FIG. 3 is a plan view which shows a schematic configuration of a maintenance device.

As shown in FIG. 3, the suction pump 37 is a tube pump which is disposed, for example, in a suction tube 37*a* that communicates with the suction cap 36. In the liquid ejecting unit 33, a plurality of nozzles 34 arranged in the transfer direction Y at a predetermined interval form nozzle rows NL. Two (a pair of) nozzle rows NL for each color of liquid are arranged at different positions in the transfer direction Y. Further, a pair of nozzle rows NL for each color are arranged in the scan direction X at a predetermined interval in the liquid ejecting unit 33.

In the liquid ejecting unit 33, an opening surface 33*a* is a surface to which the nozzles 34 are open. The liquid ejecting unit 33 includes a fixation frame 33*b* that hold a plate member having the opening surfaces 33*a*. The fixation frame 33*b* has a plurality of (in this embodiment, four) openings 33*c* so as to expose the opening surfaces 33*a* to which a plurality of nozzles 34 constituting the pairs of nozzle rows NL are open.

The maintenance device 35 includes two suction caps 36 at different positions in the scan direction X and the transfer direction Y so as to perform a suction cleaning operation for a pairs of the nozzle rows NL that correspond to each ink color. When the frame shaped edge of the two suction cap 36 comes into contact with the rectangular opening surface 33*a* in the opening 33*c* of the liquid ejecting unit 33, a closed space is formed in which the nozzles 34 are open.

The liquid ejecting unit 33 performs a flushing operation to forcibly eject (discharge) liquid droplets from the nozzles 34 independently from a printing operation for a purpose of prevention and removal of clogging of the nozzles 34. The flushing unit 39 receives liquid discharged from the nozzles 34 during the flushing operation.

The flushing unit 39 includes a liquid droplets receiving section 42 of a bottomed box shape that receives the ejected liquid droplets and a lid member 43 that covers an opening of the liquid droplets receiving section 42. The liquid droplets receiving section 42 is formed in a size that corresponds to a pair of nozzle rows NL so as to receive liquid droplets discharged during a flushing operation for each pair of the nozzle rows NL that correspond to each ink color.

The cap member 43 moves by a mechanism, which is not shown in the figure, between a position in which it covers the opening of the liquid droplets receiving section 42 and a position in which it exposes the opening of the liquid droplets receiving section 42. The liquid droplets receiving section 42 is connected to a suction tube 37*b* which extends from the suction pump 37 which is a tube pump. When the suction pump 37 is actuated, the liquid received in the liquid droplets receiving section 42 flows into the waste liquid containers 24 (see FIG. 2) via the suction tube 37*b*.

Then, a configuration of the wiping unit 38 will be described in detail. The wiping unit 38 includes a guide shaft 51 which extends in the transfer direction Y, a guide wall 52 which extends in the transfer direction Y in parallel to the guide shaft 51, a first projection 53 disposed on the guide wall 52 close to the downstream end in the transfer direction Y, a long rack member 54 that engages with the guide shaft 51 and the guide wall 52, and a driving force transmission mechanism 55. The driving force transmission mechanism 55 converts a rotation motion in one direction obtained by driving the drive source 41 into a linear motion. The long rack member 54 reciprocates in the transfer direction Y by a driving force transmitted by the driving force transmission mechanism 55.

The wiping unit 38 includes wipers 58, 59 that wipe over the liquid ejecting unit 33, a holding member 57 that holds the wipers 58, 59, and a small rack member 62. As the long rack member 54 moves downstream in the transfer direction Y, the wiping unit 38 performs a wiping operation to the liquid ejecting unit 33 with the wipers 58, 59 supported by the long rack member 54 via the holding member 57 relatively moving to the liquid ejecting unit 33 in the transfer direction Y, which is a wiping direction.

The wipers 58 are provided so as to correspond to two nozzle rows NL and wipe over a pair of nozzle rows NL by one wiping operation. The center portion of the wiper 58 in the scan direction X is formed to protrude downstream in the transfer direction Y so that a high contact pressure is applied to especially around the openings of the nozzles 34.

The wiper 59 is disposed upstream to the wipers 58 in the transfer direction Y and is formed in a plate shape extending in the scan direction X so that a uniform contact pressure is applied to a rectangular opening surface 33*a*. Alternatively, the wiping unit 38 may include only one of the wiper 58 and wiper 59.

The long rack member 54 having a longitudinal direction in the transfer direction Y includes an attachment section 56 disposed on the downstream end in the transfer direction Y which is the longitudinal direction. The holding member 57 that holds the wipers 58, 59 is rotatably mounted on the attachment section 56. Further, the small rack member 62 is held by the attachment section 56 to be relatively movable to the attachment section 56 and the holding member 57 in the transfer direction Y.

Figure 4:
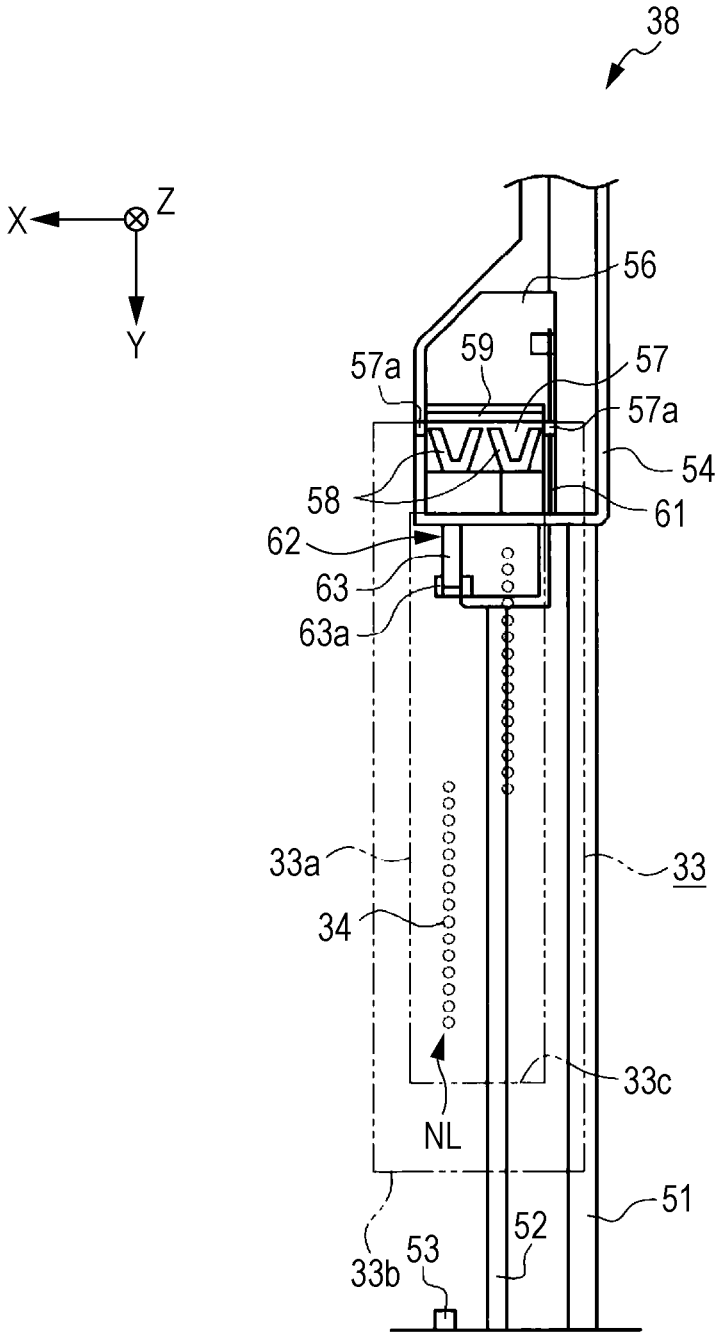
FIG. 4 is a plan view of a wiping unit which shows that a wiper is in an initial position.
Figure 5:
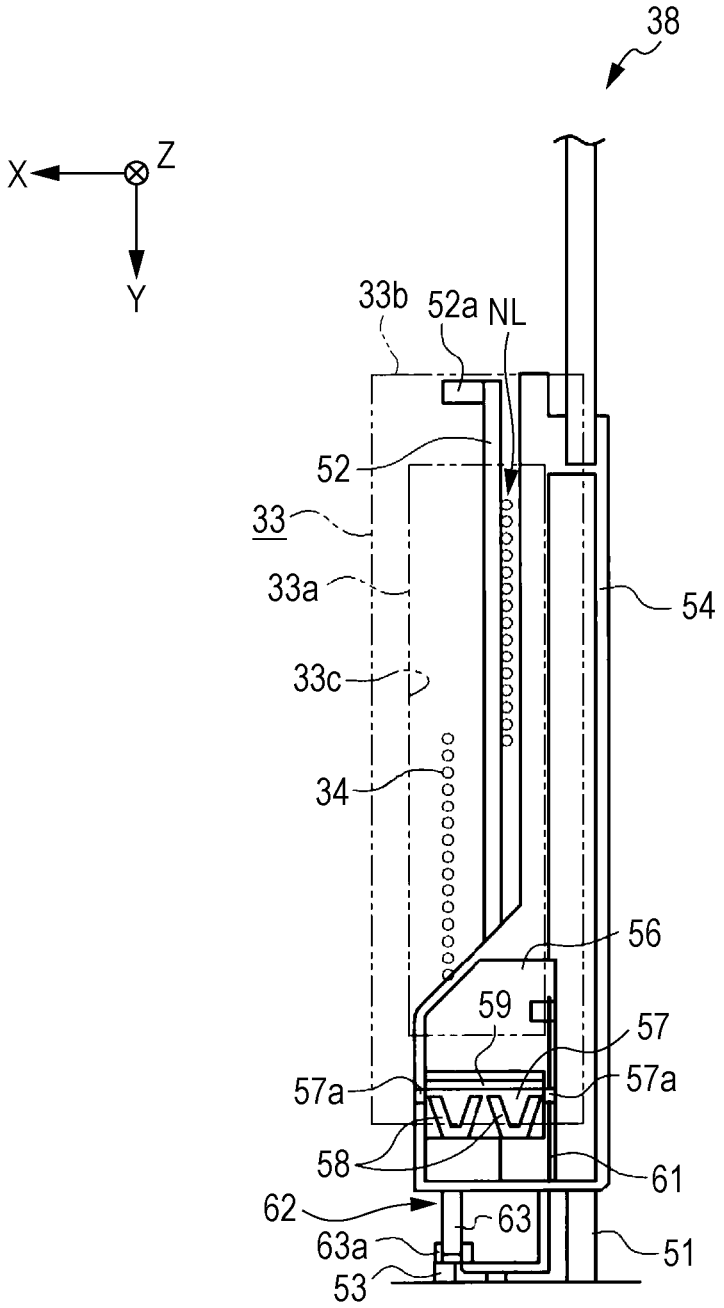
FIG. 5 is a plan view of the wiping unit which shows that the wiper is in a return position.

The wiping unit 38 performs a wiping operation with the wipers 58, 59 coming into sliding contact with the opening surface 33*a* of the liquid ejecting unit 33 while the wipers 58, 59 in a standing position perform a forward motion moving downstream in the transfer direction Y along with the long rack member 54 from an initial position shown in FIGS. 3 and 4 to a return position shown in FIG. 5. Accordingly, in this embodiment, the transfer direction Y is the wiping direction in which the wipers 58, 59 wipe over the liquid ejecting unit 33 during the wiping operation.

Further, the wipers 58, 59 after the wiping operation is switched from the standing position to the non-standing position at the return position, and the long rack member 54 performs a backward motion moving upstream in the transfer direction Y from the return position to the initial position. That is, when the long rack member 54 performs the backward motion, the wipers 58, 59 in the non-standing position can prevent unnecessary contact between the wipers 58, 59 and the liquid ejecting unit 33.

Further, a wiper cleaner that removes substances attached on the wipers 58, 59 may be provided in the vicinity of the return position so that the wiper cleaner cleans the wipers 58, 59 while the wipers 58, 59 change the positions.

As shown in FIGS. 4 and 5, the holding member 57 is configured to be rotatable about a pair of shafts 57*a* having a rotation axis in the scan direction X. The shaft 57*a* on a base end side (the right end in FIGS. 4 and 5) in the rotation axis direction is biased by a bias member 61 in a vertical direction that intersects the rotation axis direction. Although the bias member 61 of the present embodiment is a bar spring, another bias member of a different material and shape, such as a plate spring, a coil spring, or an elastically deformable rubber member may be used.

As shown in FIG. 5, the small rack member 54 includes a plate-shaped portion 63 that extends downstream in the transfer direction Y, which is a forward moving direction of the long rack member 54, and a first protrusion 63*a* is provided to protrude at a distal end of the plate-shaped portion 63. When the long rack member 54 performs the forward motion moving downstream in the transfer direction Y, the first protrusion 63*a* abuts against the first projection 53, thereby regulating movement of the small rack member 62. This causes the small rack member 62 to move upstream in the transfer direction Y relative to the long rack member 54 that is continuously performing the backward motion moving downstream in the transfer direction Y. With this relative movement, the small rack member 62 rotates the holding member 57. In so doing, upon rotation of the holding member 57, the positions of the wipers 58, 59 are switched from the standing position to the non-standing position.

Furthermore, a second projection 52*a* that protrudes in the scan direction X is provided at an upstream end of the guide wall 52 in the transfer direction Y. When the long rack member 54 performs the backward motion moving upstream in the transfer direction Y, the small rack member 62 abuts against the second projection 52*a*, thereby regulating the movement of the small rack member 62. This causes the small rack member 62 to move downstream in the transfer direction Y relative to the long rack member 54 that is continuously performing the backward motion moving upstream in the transfer direction Y. With this relative movement, the small rack member 62 rotates the holding member 57. In so doing, upon rotation of the holding member 57, the positions of the wipers 58, 59 are switched from the non-standing position to the standing position.

Figure 6:
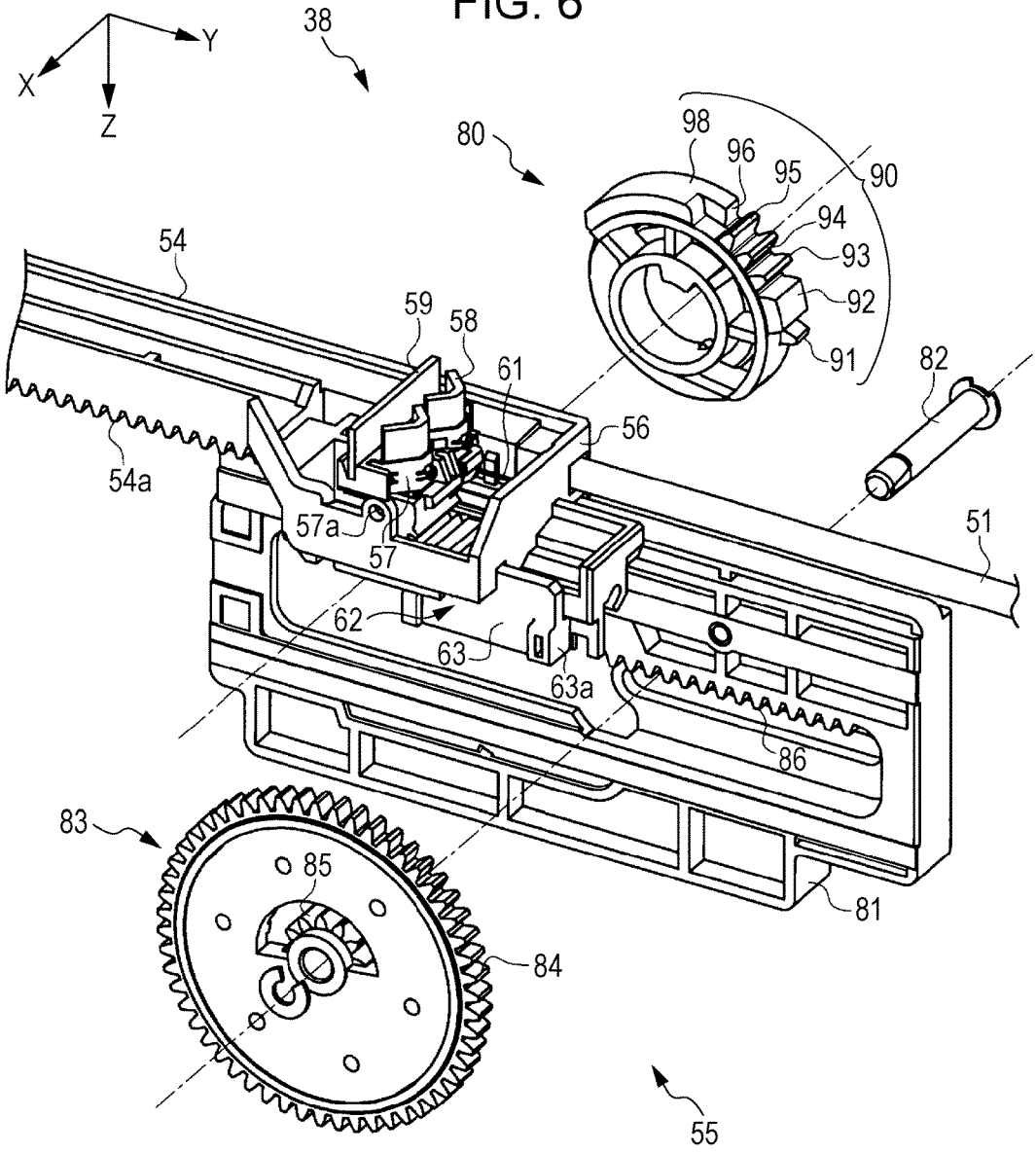
FIG. 6 is a partial exploded perspective view of the wiping unit.

Next, a configuration of the driving force transmission mechanism 55 will be described in detail. As shown in FIG. 6, the driving force transmission mechanism 55 includes an intermittent gear 80 that rotates by a driving force of a motor which is the drive source 41 (see FIG. 3), a plate-shaped double rack member 81 that is relatively movable to the intermittent gear 80 in the transfer direction Y, and a composite gear 83 rotatable about a rotation pin 82.

In the driving force transmission mechanism 55, the intermittent gear 80 causes the double rack member 81 to reciprocate in the transfer direction Y when the motor which is the drive source 41 rotates in one direction, and the composite gear 83 which rotates as the double rack member 81 moves causes the long rack member 54 to reciprocate in the transfer direction Y, thereby reciprocating the wipers 58, 59. Further, a rotation axis of the intermittent gear 80, which is not shown in the figure, is rotatably supported by the support member, which is not shown in the figure. Further, the rotation pin 82 which serves as a rotation shaft of the composite gear 83 is rotatably supported, for example, by the guide wall 52 and the double rack member 81. Both the rotation axes are not movable.

The composite gear 83 includes a small diameter gear 85 and a large diameter gear 84 having a larger number of teeth than the small diameter gear 85. When the home position side is defined as a front side and the non-home position side is defined as a back side for the respective components of the driving force transmission mechanism 55, the large diameter gear 84 is disposed on the back side of the small diameter gear 85. Further, a long rack section 54*a* that is engageable with the large diameter gear 84 is disposed to extend in the transfer direction Y on the back side of the long rack member 54 that supports the wipers 58, 59. Further, a short rack section 86 which has a smaller number of teeth than the long rack section 54*a* and is engageable with the small diameter gear 85 is disposed to extend in the transfer direction Y on the back side of the double rack member 81.

As the double rack member 81 moves in the transfer direction Y, the small diameter gear 85 that engages with the short rack section 86 rotates, thereby rotating the large diameter gear 84 of the composite gear 83. Accordingly, the long rack member 54 having the long rack section 54*a* that engages with the large diameter gear 84 moves in the same direction as the double rack member 81 at a rate faster than the double rack member 81. That is, as the double rack member 81 moves, the long rack member 54 moves in the same direction as the double rack member 81 by a distance larger than the double rack member 81.

Figure 7:
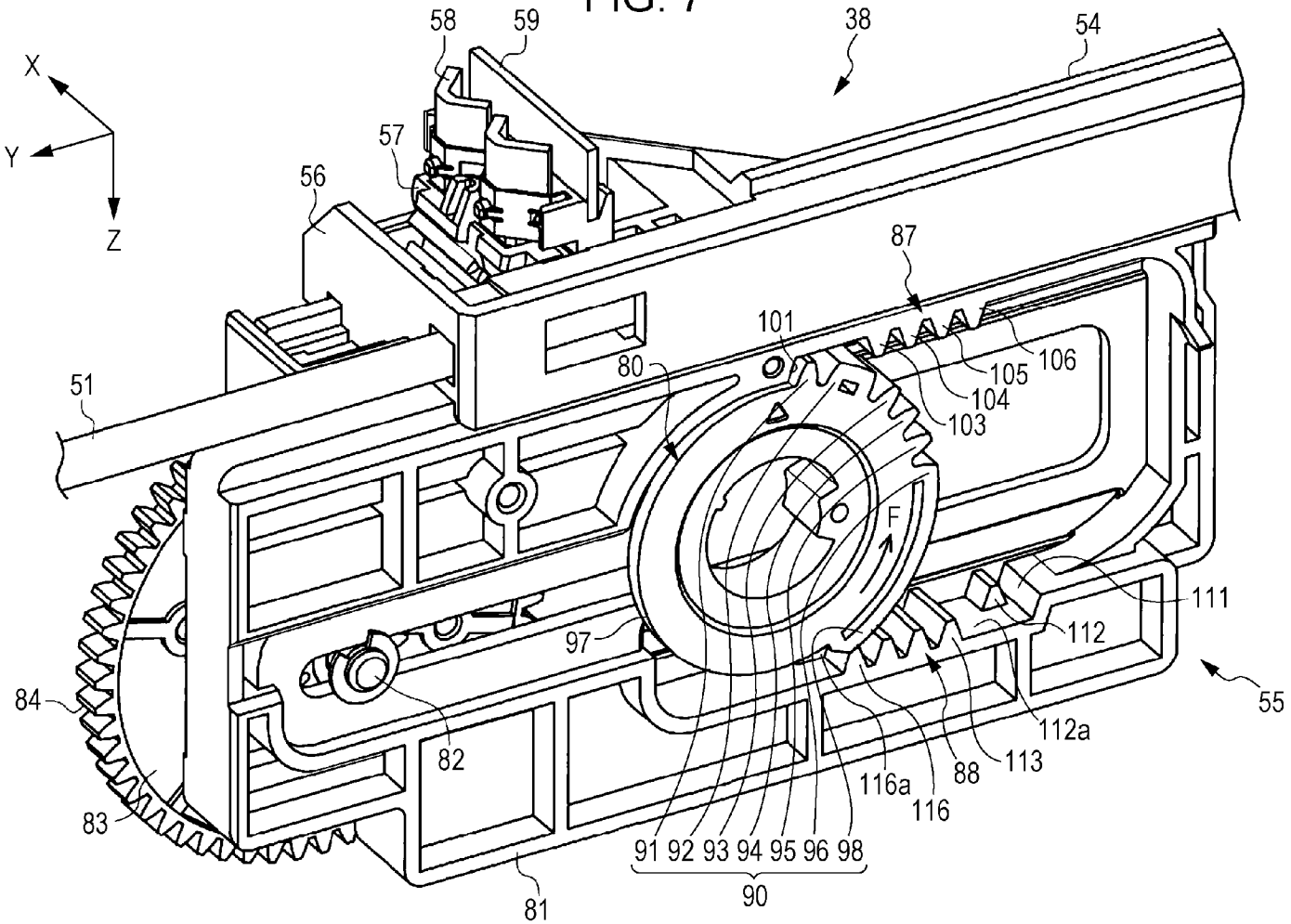
FIG. 7 is a perspective view of the wiping unit.

As shown in FIG. 7, a paired first rack section 87 and second rack section 88 are provided on the front side the of the double rack member 81 so as to extend in the transfer direction Y in a point symmetric manner with respect to each other when viewed from the home position side. The intermittent gear 80 includes a teeth portion 90 that alternatively engages with the two paired rack sections 87, 88 during rotation to one direction F, and a toothless portion 97 that is arranged in line with the teeth portion 90 in the rotation direction.

The teeth portion 90 of the intermittent gear 80 includes tooth-shaped projections 91, 92, 93, 94, 95, 96 made up of a plurality of (in this embodiment, six) convex portions arranged in the rotation direction. In the teeth portion 90, the tooth-shaped projections 93, 94, 95 are standard teeth provided at a normal pitch. The tooth-shaped projection 92 positioned between the tooth-shaped projection 91 and the tooth-shaped projection 93 includes a toothless area with an absence of formation of a single gear tooth space.

The tooth-shaped projection 96 includes a tooth surface that faces an adjacent tooth surface of the tooth-shaped projection 95, and is integrally formed with a projection 98 formed of a toothless area with an absence of formation of a plurality of gear tooth spaces. The projection 98 extending in the rotation direction is a portion of the toothless portion 97. After the teeth portion 90 disengages from one of the rack sections 87, 88, the projection 98 comes into contact with the disengaged rack sections 87, 88 before the teeth portion 90 engages with the other of the rack sections 87, 88, thereby preventing the double rack member 81 from moving.

Figure 8:
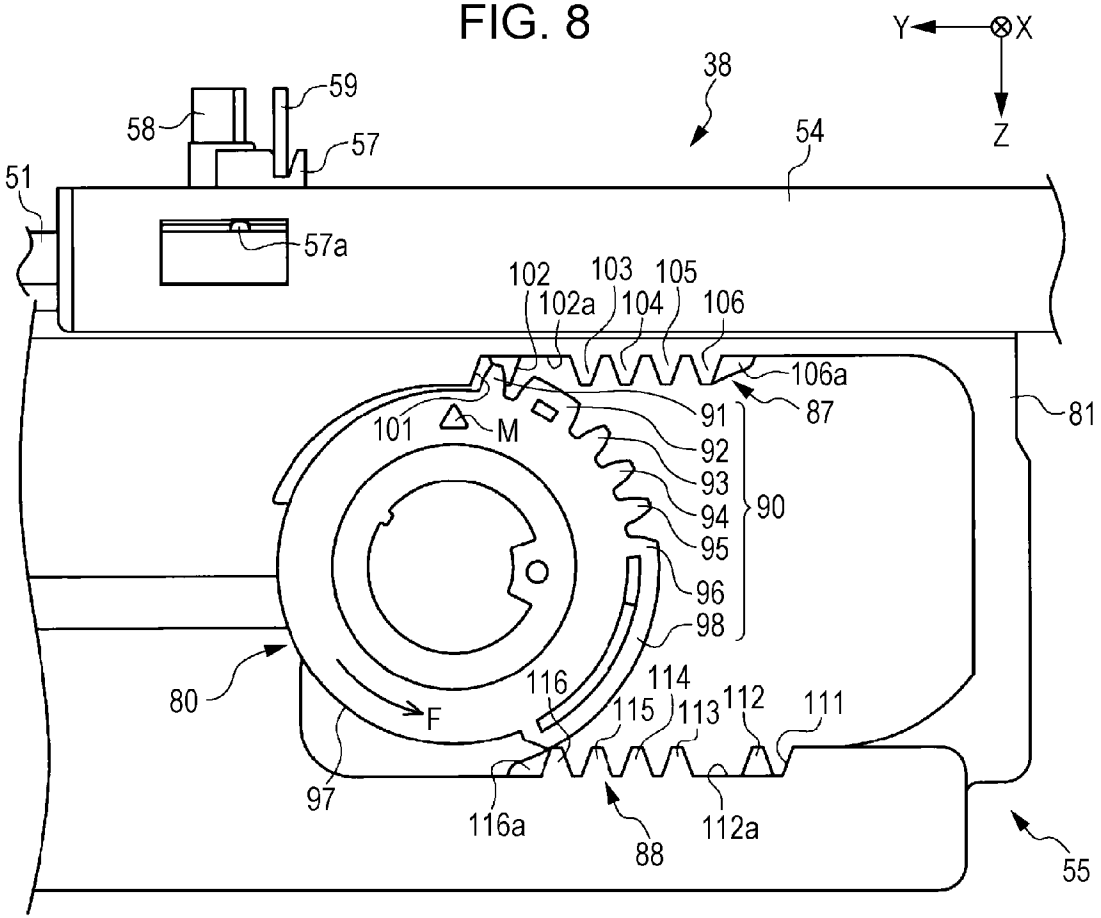
FIG. 8 is a side view of the wiping unit.

As shown in FIG. 8, the first rack section 87 includes tooth-shaped projections 101, 102, 103, 104, 105, 106 made up of a plurality of (in this embodiment, six) convex portions arranged in the transfer direction Y from downstream to upstream. In the first rack section 87, the tooth-shaped projections 103, 104, 105 are standard teeth disposed at a normal pitch.

A toothless area 102*a* formed with an absence of a single tooth-shaped projection of a normal pitch is disposed between the tooth-shaped projection 102 and the tooth-shaped projection 103. The tooth-shaped projection 101 located on the downstream end in the transfer direction Y includes a tooth surface that faces an adjacent tooth surface of the tooth-shaped projection 102. Further, the tooth-shaped projection 106 located on the upstream end in the transfer direction Y includes an extension portion 106*a* that extends from the tooth surface on the upstream side in the transfer direction Y while inclining upstream in the transfer direction Y. The extension portion 106*a* comes into contact with the projection 98 of the intermittent gear 80 after the teeth portion 90 of the intermittent gear 80 disengages from the first rack section 87 (see FIG. 14).

The second rack section 88 includes tooth-shaped projections 111, 112, 113, 114, 115, 116 made up of a plurality of (in this embodiment, six) convex portions arranged in the transfer direction Y, which is the wiping direction, from upstream to downstream. In the second rack section 88, the tooth-shaped projections 113, 114, 115 are standard teeth disposed at a normal pitch.

A toothless area 112*a* formed with an absence of a single tooth-shaped projection of a normal pitch is disposed between the tooth-shaped projection 112 and the tooth-shaped projection 113. The tooth-shaped projection 111 located on the upstream end in the transfer direction Y includes a tooth surface that faces an adjacent tooth surface of the tooth-shaped projection 112. Further, the tooth-shaped projection 116 located on the downstream end in the transfer direction Y includes an extension portion 116*a* that extends from the tooth surface on the downstream side in the transfer direction Y while inclining downstream in the transfer direction Y. The extension portion 116*a* comes into contact with the projection 98 of the intermittent gear 80 after the teeth portion 90 of the intermittent gear 80 disengages from the second rack section 88.

When the teeth portion 90 of the intermittent gear 80 engages with the first rack section 87, the tooth-shaped projections 91, 92, 93, 94, 95, 96 of the teeth portion 90 engage with the tooth-shaped projections 101, 102, 103, 104, 105, 106 of the first rack section 87, respectively. Further, when the teeth portion 90 of the intermittent gear 80 engages with the second rack section 88, the tooth-shaped projections 91, 92, 93, 94, 95, 96 of the teeth portion 90 engage with the tooth-shaped projections 111, 112, 113, 114, 115, 116 of the second rack section 88.

Accordingly, first engaging parts in the rack sections 87, 88 which are located on the downstream end in the moving direction of the double rack member 81 are the tooth-shaped projections 101, 111, respectively. Further, second engaging parts which are located adjacent to the first engaging parts in the moving direction are the tooth-shaped projections 102, 112, respectively. The engaging parts in the rack sections 87, 88 that first engage with the teeth portion 90 of the intermittent gear 80 are the first engaging parts located on the downstream end in the moving direction, and the tooth-shaped projections 106, 116 located on the upstream end in the moving direction are the engaging parts that lastly engage with the teeth portion 90 of the intermittent gear 80.

Further, the first tooth in the teeth portion 90 of the intermittent gear 80 that engages with the first engaging parts of the rack sections 87, 88 is the tooth-shaped projection 91, and the second tooth that engages with the second engaging parts is the tooth-shaped projection 92. The last tooth in the teeth portion 90 of the intermittent gear 80 that engages with the last engaging parts is the tooth-shaped projection 96.

Figure 9:
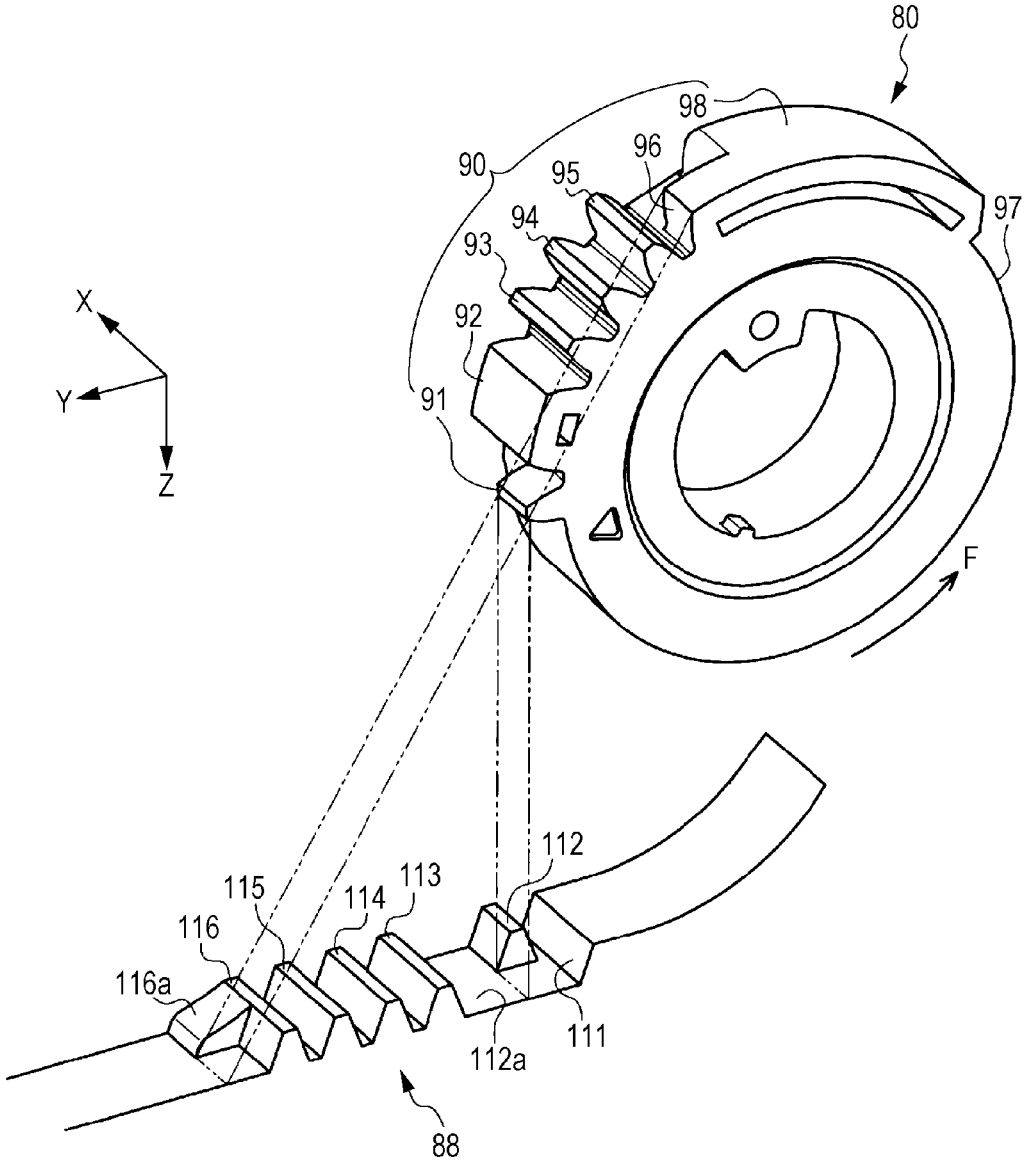
FIG. 9 is a perspective view of an intermittent gear and a rack section.

As shown in FIG. 9, the tooth-shaped projection 91, which is the first tooth of the intermittent gear 80, and the tooth-shaped projection 96, which is the last engaging part of the intermittent gear 80 have the length in the scan direction X, which is the rotation axis direction of the intermittent gear 80, smaller than those of the tooth-shaped projections 92, 93, 94, 95 located between the tooth-shaped projection 91 and the tooth-shaped projection 96. For example, although the positions of the end faces of the tooth-shaped projections 91, 92, 93, 94, 95, 96 are aligned on the front side, the positions of the end faces of the tooth-shaped projections 91, 96 are located closer to the home position than the positions of the end faces of the tooth-shaped projections 92, 93, 94, 95 on the back side. In FIG. 9, for illustration purpose of the configuration of the intermittent gear 80, the relative position to the second rack section 88 is modified.

In the rack sections 87, 88, the tooth-shaped projections 102, 112 which engage with the tooth-shaped projection 92, which is the second tooth of the intermittent gear 80, are positioned such that the intermittent gear 80 does not engage with the tooth-shaped projection 91, which is the first tooth, when the intermittent gear 80 engages with the rack sections 87, 88. For example, the tooth-shaped projections 102, 112 are located on the non-home position side in the rotation axis direction of the intermittent gear 80 with respect to the moving path of the tooth-shaped projection 91 (the end face of the tooth-shaped projection 91 on the back side). Further, the extension portions 106*a*, 116*a* which extend from the tooth-shaped projection 106, 116 are located on the non-home position side in the rotation axis direction of the intermittent gear 80 with respect to the moving path of the tooth-shaped projection 96 (the end face of the tooth-shaped projection 96 on the back side).

Accordingly, as shown in FIG. 8, when the teeth portion 90 of the intermittent gear 80 engages with the first rack section 87, the tooth-shaped projection 91 of the intermittent gear 80 rotates without engaging with the tooth-shaped projection 102. As a result, the tooth-shaped projections 91, 92 of the intermittent gear 80 engage with the tooth-shaped projections 101, 102 of the first rack section 87, respectively, at the same timing, and the tooth-shaped projection 92 is housed in the toothless area 102*a*.

Further, as shown in FIG. 9, when the teeth portion 90 of the intermittent gear 80 engage with the second rack section 88, the tooth-shaped projection 91 of the intermittent gear 80 rotates without engaging with the tooth-shaped projection 112. As a result, the tooth-shaped projections 91, 92 of the intermittent gear 80 engage with the tooth-shaped projections 111, 112 of the second rack section 88, respectively, at the same timing, and the tooth-shaped projection 92 is housed in the toothless area 112*a*.

Next, a reciprocating movement of the double rack member 81 during one rotation of the intermittent gear 80 in one direction F will be described. When the wipers 58, 59 in the standing position are positioned at the initial position shown in FIGS. 3 and 4, the intermittent gear 80 is located at a rotation reference position (with rotation angle 0°) shown in FIG. 8. When a rotation reference mark M is provided on the intermittent gear 80 and the intermittent gear 80 is positioned at the rotation reference position, the reference mark M is oriented vertically upward. Further, when the intermittent gear 80 is positioned at the rotation reference position, the teeth portion 90 of the intermittent gear 80 is located vertically lower side of the first rack section 87, and the tooth-shaped projections 91, 92 of the intermittent gear 80 are located upstream in the transfer direction Y with respect to the tooth-shaped projections 101, 102 of the first rack section 87, respectively.

When the motor which is the drive source 41 (see FIG. 3) rotates in one direction, the intermittent gear 80 starts to rotate in one direction F from the rotation reference position. As the tooth-shaped projections 91, 92 of the intermittent gear 80 engage with and push the tooth-shaped projections 101, 102 of the first rack section 87, the double rack member 81 starts to move downstream in the transfer direction Y.

Subsequently, the tooth-shaped projections 93, 94, 95, 96 of the intermittent gear 80 engage with the tooth-shaped projections 103, 104, 105, 106 of the first rack section 87 in sequence so that the double rack member 81 moves downstream in the transfer direction Y. Accordingly, by the action of the composite gear 83, the long rack member 54 moves downstream in the transfer direction Y in a rate faster than the double rack member 81. With this movement, the wipers 58, 59 perform a wiping operation.

Figure 10:
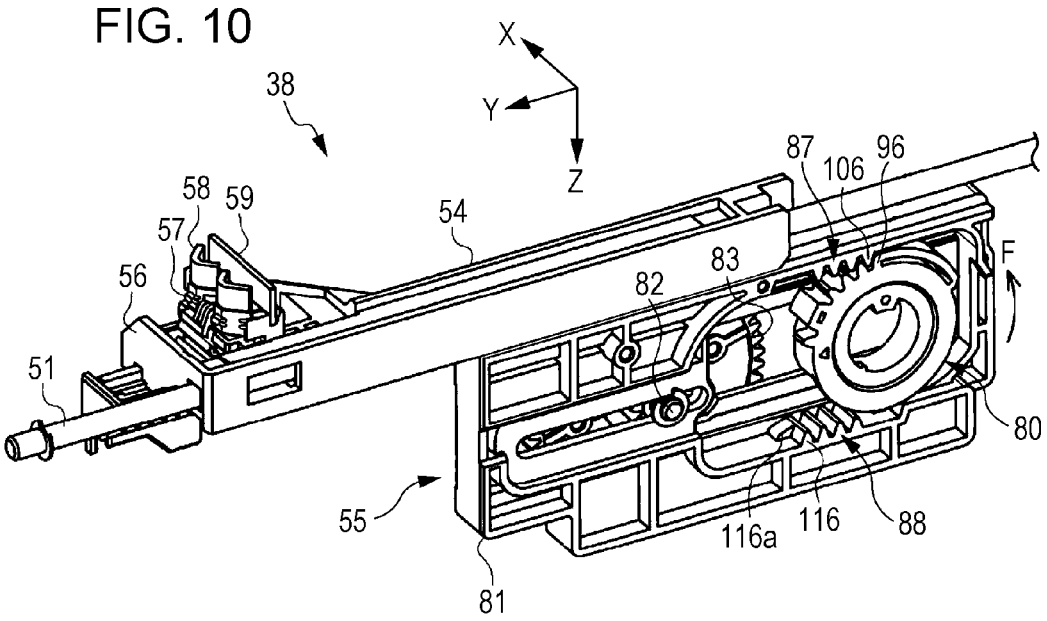
FIG. 10 is a perspective view of the wiping unit when the last tooth of the intermittent gear engages with a first rack section.

As shown in FIG. 10, the tooth-shaped projection 96 which is the last tooth of the intermittent gear 80 engages with the tooth-shaped projection 106 which is the last engaging part of the first rack section 87, the rotation angle of the intermittent gear 80 from the rotation reference position becomes substantially 90°.

Figure 11:
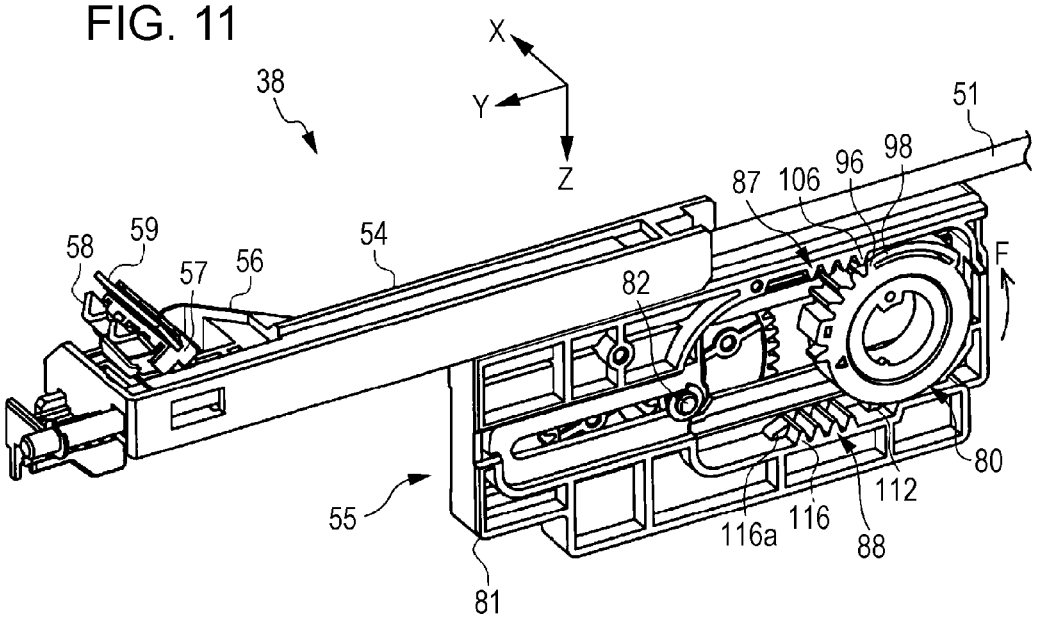
FIG. 11 is a perspective view of the wiping unit when the intermittent gear disengages from the rack section.

As shown in FIG. 11, immediately before the long rack member 54 reaches the return position, the wipers 58, 59 are switched from the standing position to the non-standing position. Then, when the intermittent gear 80 disengages from the first rack section 87, the double rack member 81 stops the forward motion moving downstream in the transfer direction Y. In so doing, the long rack member 54 that holds the wipers 58, 59 reaches the return position.

After the intermittent gear 80 disengages from the first rack section 87 and the double rack member 81 stops the motion, the intermittent gear 80 continuously rotates in one direction F. In so doing, the projection 98 of the intermittent gear 80 engages with the tooth-shaped projection 106, thereby preventing the double rack member 81 from moving upstream in the transfer direction Y.

Figure 12:
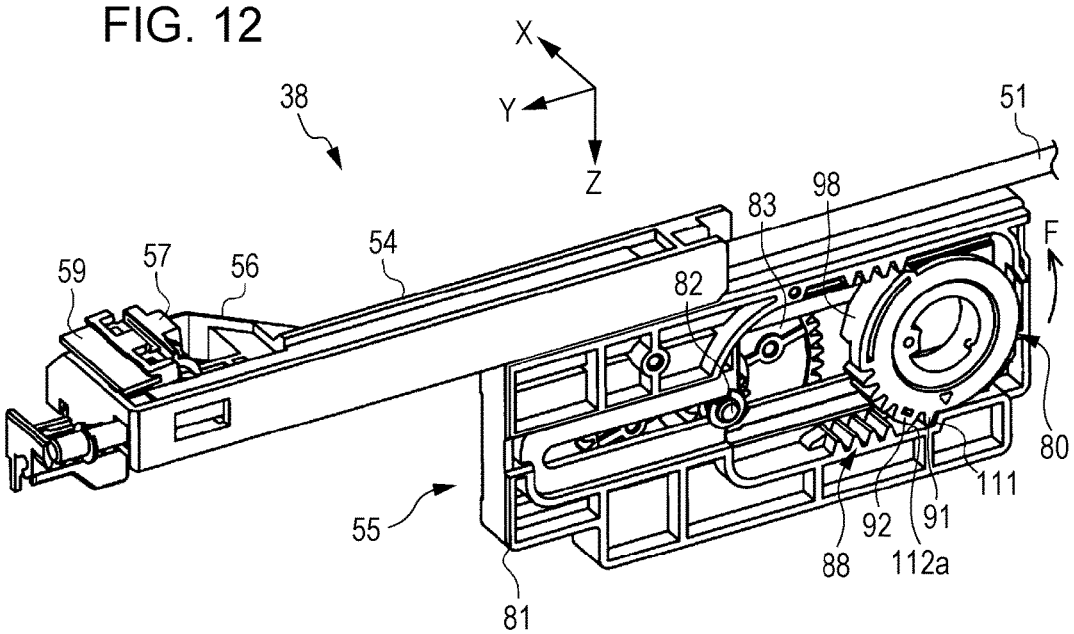
FIG. 12 is a perspective view of the wiping unit when the intermittent gear engages with the rack section.

As shown in FIG. 12, when the rotation angle of the intermittent gear 80 from the rotation reference position becomes substantially 180°, the tooth-shaped projections 91, 92 of the intermittent gear 80 engage with the tooth-shaped projections 111, 112 of the second rack section 88, respectively. Accordingly, the double rack member 81 starts to move upstream in the transfer direction Y.

Subsequently, the tooth-shaped projections 93, 94, 95, 96 of the intermittent gear 80 engage with the tooth-shaped projections 113, 114, 115, 116 of the second rack section 88, respectively, so that the double rack member 81 moves upstream in the transfer direction Y. In so doing, by the action of the composite gear 83, the long rack member 54 moves upstream in the transfer direction Y in a rate faster than the double rack member 81.

Figure 13:
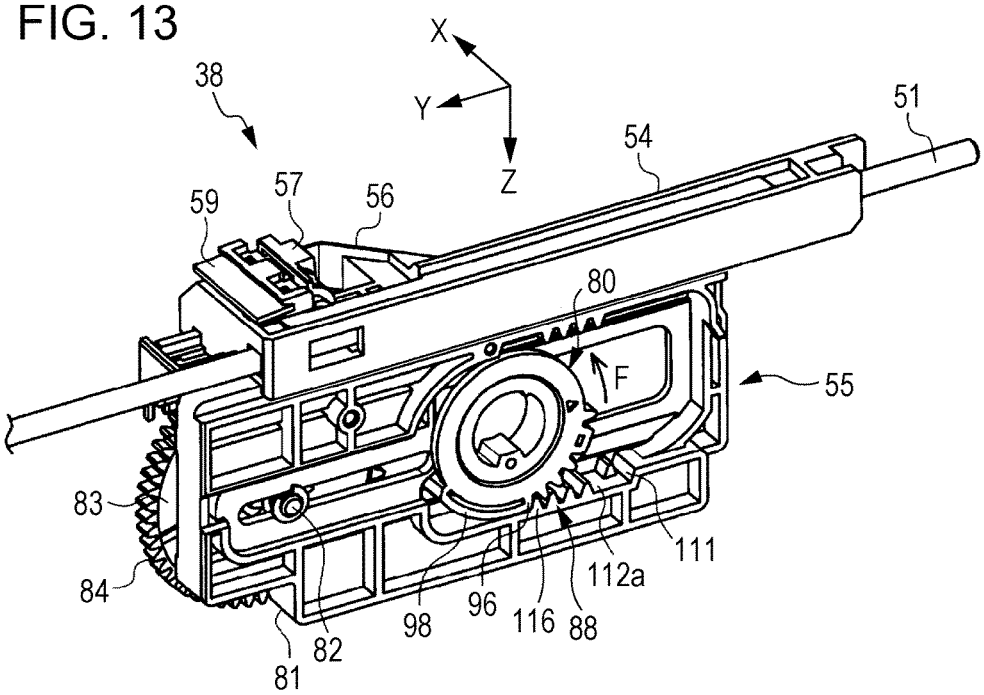
FIG. 13 is a perspective view of the wiping unit when the last tooth of the intermittent gear engages with a second rack section.

As shown in FIG. 13, immediately before the long rack member 54 reaches the initial position after the tooth-shaped projection 96 which is the last tooth of the intermittent gear 80 engages with the tooth-shaped projection 116 which is the last engaging part of the second rack section 88, the wipers 58, 59 are switched from the non-standing position to the standing position.

Then, when the intermittent gear 80 disengages from the second rack section 88, the double rack member 81 stops the backward motion moving upstream in the transfer direction Y. In so doing, the long rack member 54 that holds the wipers 58, 59 reaches the initial position.

After the intermittent gear 80 disengages from the second rack section 88 and the double rack member 81 stops the motion, the intermittent gear 80 continuously rotates in one direction F. In so doing, the projection 98 of the intermittent gear 80 engages with the tooth-shaped projection 116, thereby preventing the double rack member 81 from moving downstream in the transfer direction Y.

Next, the action of the maintenance device 35 and the liquid ejecting apparatus 11 having the above configuration will be described, especially focusing on the function of the wiping unit 38. In the wiping unit 38, the double rack member 81 allows for forward motion of the wipers 58, 59 when the intermittent gear 80 engages with the first rack section 87 and backward motion of the wipers 58, 59 when the intermittent gear 80 engages with the second rack section 88. Accordingly, the action of the driving force transmission mechanism 55 allows the wipers 58, 59 to move in a reciprocating manner by rotation of the intermittent gear 80 in one direction F without switching the drive direction of the drive source 41.

That is, when the intermittent gear 80 rotates in one direction F by 180°, the wipers 58, 59 perform the forward motion along with the double rack member 81 and the long rack member 54 in the wiping direction and wipe the liquid ejecting unit 33. When the intermittent gear 80 further rotate in one direction F by 180°, the wipers 58, 59 perform the backward motion in a direction opposite to the wiping direction. Accordingly, compared with the case where the wipers 58, 59 perform the forward motion by means of rotation of the drive source 41 in one direction and the backward motion by means of rotation of the drive source 41 in the other direction, it is possible to simplify control of the drive source 41 associated with the wiping operation since the drive direction of the drive source 41 does not need to be changed to reverse the moving direction of the wipers 58, 59.

Further, in the maintenance device 35, it is also possible by using a single drive source 41 to perform operations of a plurality of components such as movement of the caps 36, 40, driving of the suction pump 37, movement of the cap member 43 of the flushing unit 39 as well as movement of the wipers 58, 59. As described above, when a plurality of components are operated by a single drive source 41, switching of the drive direction of the drive source 41 for one component effects on the operation of the other components. Accordingly, it is preferable to simplify control of the drive source 41 that is performed for one component. In this sense, the present embodiment is suitable for operating a plurality of components by a single drive source 41 since the wipers 58, 59 can be moved in a reciprocating manner without changing the drive direction of the drive source 41.

In addition, the number of teeth provided in the teeth portion 90 of the intermittent gear 80 may be modified depending on a moving distance of the wipers 58, 59 necessary for the wiping operation. For example, in the present embodiment, instead of providing the teeth portion 90 on all the approximately half of the outer periphery of the intermittent gear 80, the projection 98 may be provided on part of the half of the outer periphery to adjust the moving distance of the wipers 58, 59. That is, the wipers 58, 59 do not move as far as the projection 98 of the intermittent gear 80 is in contact with the rack sections 87, 88 regardless of rotation of the intermittent gear 80 in one direction F.

Figure 14:
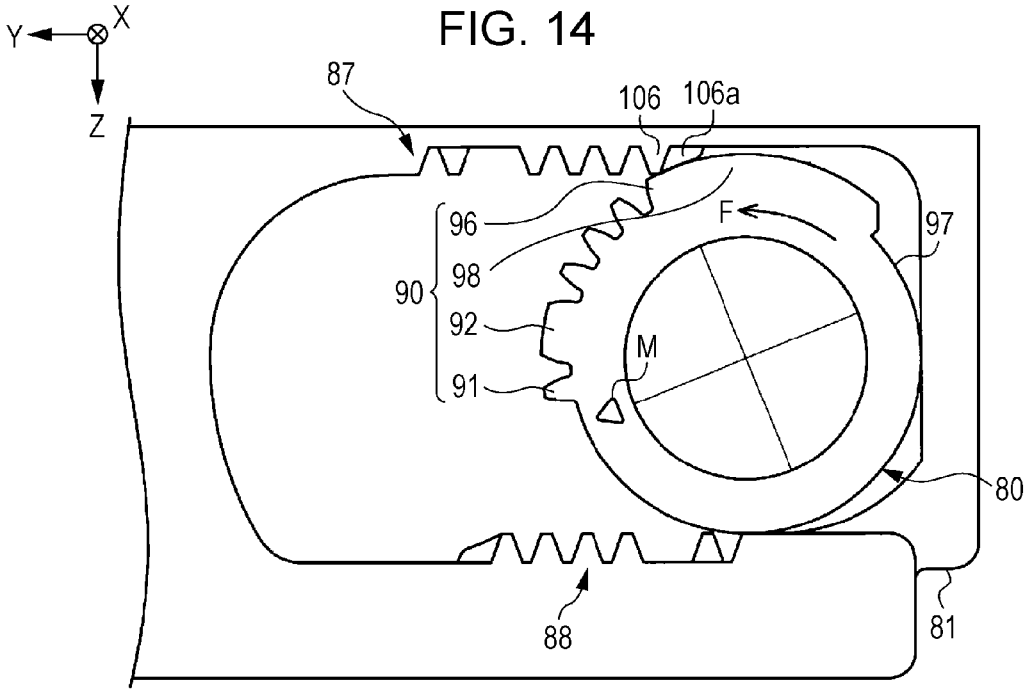
FIG. 14 is a side view which shows a projection of the intermittent gear that comes into contact with the first rack section.

For example, as shown in FIG. 14, before the first tooth of the intermittent gear 80 engages with the second rack section 88 after the last tooth of the intermittent gear 80 disengages from the last engaging part of the first rack section 87, the projection 98 is in contact with the distal end of the tooth-shaped projection 106 or the extension portion 106*a* of the first rack section 87 so that the double rack member 81 stops while being prevented from moving upstream in the transfer direction Y. Accordingly, even if an external force is applied on the double rack member 81 which stops due to vibration or the like, the position of the double rack member 81 is not displaced upstream in the transfer direction Y.

Figure 15:
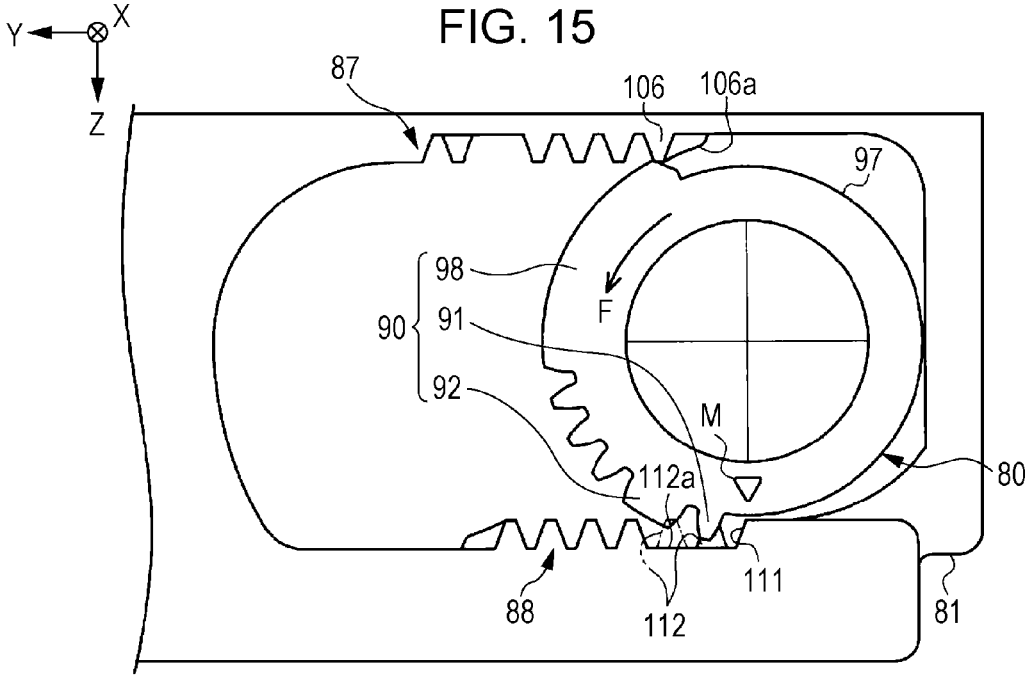
FIG. 15 is a side view which shows the action of the intermittent gear and the rack section.

As shown in FIG. 15, assuming that the double rack member 81 is unintentionally moved downstream in the transfer direction Y by an external force or the like and the tooth-shaped projection 112 is moved to a position indicated by the two-dotted line in FIG. 15 when the double rack member 81 stands-by the backward motion after it finishes the forward motion. In this case also, the tooth-shaped projection 112 does not engage with the tooth-shaped projection 91 since the tooth-shaped projection 112 is displaced in the rotation axis direction from the tooth-shaped projection 91 which is the first tooth of the intermittent gear 80. Further, the tooth-shaped projection 92 which is the second tooth of the intermittent gear 80 does not engage with the second rack section 88 since the toothless area 112*a* formed with an absence of a single tooth-shaped projection of a normal pitch between the tooth-shaped projection 112 and the tooth-shaped projection 113. As a result, deviation of the engaging positions such as the case where the first tooth of the intermittent gear 80 engages with the second engaging parts of the rack sections 87, 88 is not likely to occur.

As shown in FIG. 15, when the intermittent gear 80 rotates by approximately 180° from the rotation reference position (rotation angle 0°), the projection 98 moves away from the first rack section 87 at a timing when the first tooth of the intermittent gear 80 starts to engage with the second rack section 88. This releases the double rack member 81 from regulation of movement upstream in the transfer direction Y. Accordingly, when the intermittent gear 80 rotates while engaging with the second rack section 88, the double rack member 81 performs the backward motion moving upstream in the transfer direction Y.

Figure 16:
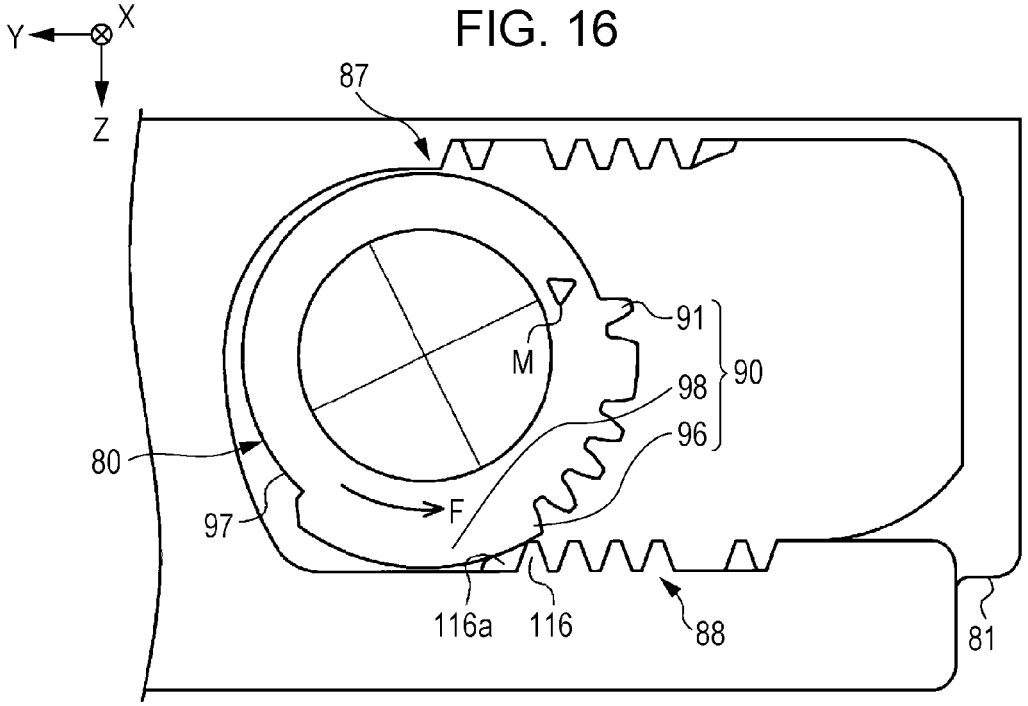
FIG. 16 is a side view which shows a projection of the intermittent gear that comes into contact with the second rack section.

Similarly, as shown in FIG. 16, before the first tooth of the intermittent gear 80 engages with the first rack section 87 after the last tooth of the intermittent gear 80 disengages from the last engaging part of the second rack section 88, the projection 98 is in contact with the distal end of the tooth-shaped projection 116 or the extension portion 116*a* of the second rack section 88 so that the double rack member 81 stops while being prevented from moving downstream in the transfer direction Y. Accordingly, even if an external force is applied on the double rack member 81 which stops due to vibration or the like, the position of the double rack member 81 is not displaced downstream in the transfer direction Y.

Figure 17:
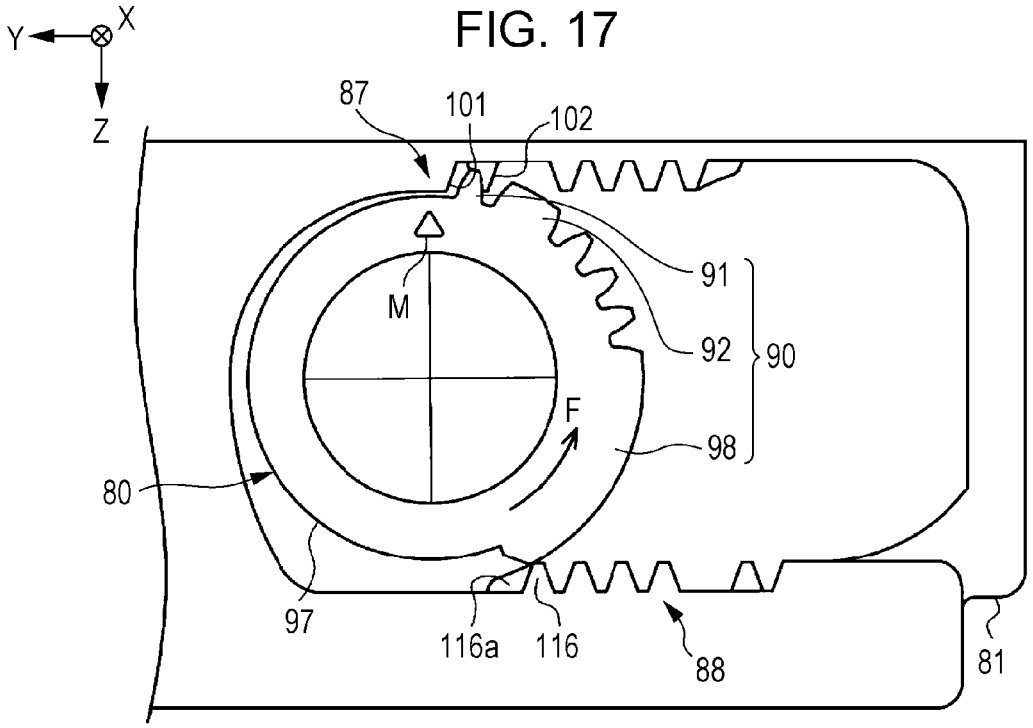
FIG. 17 is a side view which shows the intermittent gear and a double rack member in a rotation reference position.

As shown in FIG. 17, when the intermittent gear 80 rotates by one turn (360° rotation) from the rotation reference position (rotation angle 0°), the projection 98 moves away from the second rack section 88 at a timing when the first tooth of the intermittent gear 80 starts to engage with the first rack section 87. This releases the double rack member 81 from regulation of movement downstream in the transfer direction Y. Accordingly, when the intermittent gear 80 rotates while engaging with the first rack section 87, the double rack member 81 performs the forward motion moving downstream in the transfer direction Y.

According to the above embodiment, the following effect can be achieved.

(1) When the intermittent gear 80 rotates in one direction F by a predetermined rotation angle while the teeth portion 90 of the intermittent gear 80 engages with the first rack section 87 of the double rack member 81, the wipers 58, 59 perform the forward motion. Then, when the intermittent gear 80 rotates in the one direction F, the teeth portion 90 of the intermittent gear 80 engages with the second rack section 88 of the double rack member 81, and when the intermittent gear 80 further rotates in the one direction F, the wipers 58, 59 perform the backward motion. That is, since the wipers 58, 59 reciprocate with the rotation of the intermittent gear 80 in one direction F, the wipers 58, 59 can reciprocate without switching the drive direction of the drive source 41 that rotates the intermittent gear 80.

(2) While the wipers 58, 59 move with the teeth portion 90 of the intermittent gear 80 engaging with the rack sections 87, 88, the double rack member 81 is pushed by the teeth portion 90 via the rack sections 87, 88. Accordingly, it does not move in the opposite direction of the moving direction. However, during the period from when the teeth portion 90 of the intermittent gear 80 moves away from one rack section to when it engages with the other rack section, there is a risk that the double rack member 81 unintentionally moves due to an external force since it is not in contact with the teeth portion 90. In the above embodiment, however, after the teeth portion 90 of the intermittent gear 80 disengages from one rack section, the projection 98 which is part of the toothless portion 97 comes into contact with the disengaged rack section, thereby preventing unnecessary movement of the double rack member 81. Accordingly, the double rack member 81 can remain in position until the teeth portion 90 of the intermittent gear 80 engages with the other rack section so that the teeth portion 90 of the intermittent gear 80 appropriately engages the other rack section.

(3) After the teeth portion 90 of the intermittent gear 80 moves away from one rack section, the projection 98 of the toothless portion 97 comes into contact with the one rack section to prevent unnecessary movement of the double rack member 81. The projection 98 of the toothless portion 97 moves away from the one rack section at a timing when the teeth portion 90 of the intermittent gear 80 starts to engage with the other rack section. Accordingly, when the teeth portion 90 of the intermittent gear 80 engages with the other rack section, the double rack member 81 is allowed to move by rotation of the intermittent gear 80.

(4) While the first engaging part and the second engaging part of the rack sections 87, 88 with which the first tooth (tooth-shaped projection 91) and the second tooth (tooth-shaped projection 92) of the intermittent gear 80 engage, respectively, are aligned in the moving direction of the double rack member 81, the second engaging part is disposed at a position that does not engage with the first tooth. As a result, when the intermittent gear 80 rotates in one direction F, the first tooth does not engage with the second engaging part and engages with the first engaging part which is located further downstream in the moving direction. Accordingly, even if the double rack member 81 is unintentionally displaced downstream in the moving direction when the intermittent gear 80 does not engage with the rack sections 87, 88, the first tooth does not engage with the second engaging part, thereby preventing occurrence of deviation in engagement between the intermittent gear 80 and the rack sections 87, 88.

(5) When the double rack member 81 moves by rotation of the intermittent gear 80, the small diameter gear 85 which engages with the short rack section 86 of the double rack member 81 rotates, thereby rotating the large diameter gear 84 of the composite gear 83. Accordingly, the wipers 58, 59 moves along with the long rack member 54 which includes the long rack section 54*a* that engages with the large diameter gear 84. Since the large diameter gear 84 that moves the long rack member 54 has a larger number of teeth than the small diameter gear 85 that rotates by movement of the double rack member 81, the moving distance of the long rack member 54 can be larger than the moving distance of the double rack member 81. Accordingly, the moving distance of the wipers 58, 59 can be increased depending on the size and position of an area to be wiped in the liquid ejecting unit 33.

In addition, the above embodiment may also be modified as the following modified examples.

The teeth portion 90 and the rack sections 87, 88 may be formed by only standard teeth (tooth-shaped projections) having the same length in the rotation axis direction which are aligned at a normal pitch instead of the toothless portion or the toothless area provided in the teeth portion 90 of the intermittent gear 80 and the rack sections 87, 88 of the double rack member 81.

The intermittent gear 80 may not be necessarily provided with the projection 98. Alternatively, the projection 98 of the intermittent gear 80 may have smaller length in the rotation direction.

The wiping unit 38 may not necessarily include the composite gear 83 and the long rack member 54, and the double rack member 81 may hold the wipers 58, 59.

The extension portions 106*a*, 116*a* may not necessarily be provided on the tooth-shaped projections 106, 116, respectively, and the projection 98 may be configured to be in contact with the distal ends of the tooth-shaped projections 106, 116 only when the intermittent gear 80 disengages from the rack sections 87, 88. However, it is preferable to provide the extension portions 106*a*, 116*a* on the tooth-shaped projections 106, 116, respectively, to increase the contact area with the projection 98 so as to prevent the tooth-shaped projections 106, 116 from wearing out, thereby reliably preventing movement of the double rack member 81.

The wiping unit 38 may not necessarily include the bias member 61.

In addition to the wipers 58, 59 of the above embodiment, the holding member 57 may include another wiper that assumes a standing position when the wipers 58, 59 assume the non-standing position and assumes a non-standing position when the wipers 58, 59 assume the standing position. In this case, the wiping operation can be performed by the wipers 58, 59 when the long rack member 54 performs the forward motion, and the wiping operation can be performed by another wiper when the long rack member 54 performs the backward motion. As a result, for example, the wipers 58, 59 having high scraping ability may be used to wipe off a solid substance and then another wiper having high liquid absorbing ability may be used for finishing. Accordingly, double wiping by the wipers having different properties can be effectively performed. In addition, the shape and properties of the wiper may be appropriately modified. For example, the wiper may be replaced with an absorbent that absorbs liquid or the wiper may be formed in the form of roll.

The maintenance device 35 is not limited to that is fixedly mounted in the liquid ejecting apparatus 11, and may be detachably mounted in the main body 13.

The components of the maintenance device 35 are not limited to those described in the above embodiment, and for example, the maintenance device 35 may include only the wiping unit 38, or alternatively, the maintenance device 35 may also include a suction mechanism that can simultaneously suction all the nozzles 34 in addition to the wiping unit 38.

The liquid ejecting apparatus 11 may be modified to a so-called on carriage type in which the container holding unit 22 is mounted on the carriage 32.

The liquid container 21 is not necessarily entirely housed in the main body 13, and the liquid container 21 mounted in the container holding unit 22 can partially extend from the main body 13.

The liquid ejecting apparatus 11 may be modified to a so-called full-line type liquid ejecting apparatus that includes a long fixed type liquid ejecting unit which correspond to the entire width of a medium without having the carriage 32. The liquid ejecting unit in such a case may be configured to include a plurality of unit heads arranged side by side with the nozzles formed in each unit head so that the printing area covers the entire width of the medium, or include a single long head with a plurality of nozzles formed across the entire width of the head so that the printing area covers the entire width of the medium.

The liquid ejected by the liquid ejecting unit is not limited to ink, and may be a liquid material, for example, made up of particles of functional material dispersed or mixed in the liquid. For example, a configuration is possible in which recording is performed by ejecting a liquid material which contains dispersed or dissolved materials such as electrode materials and color materials (pixel materials) used for manufacturing of liquid crystal displays, electroluminescence (EL) displays and surface light-emitting displays.

The medium is not limited to sheets of paper, and may be plastic films or thin plate-shaped materials, or fabrics used for textile printing.

The entire disclosure of Japanese Patent Application No. 2015-102526, filed May 20, 2015 is expressly incorporated by reference herein.

What is claimed is:

1. A maintenance device comprising:

a wiper that wipes a liquid ejecting unit;

a double rack member which includes a pair of rack sections made up of a first rack section and a second rack section and is configured to reciprocate the wiper; and an intermittent gear which includes a teeth portion which meshes with one of two paired rack sections during rotation in one direction and a toothless portion which is arranged in line with the teeth portion in a rotation direction, wherein the double rack member allows the wiper to perform a forward motion when the first rack section meshes with the intermittent gear, and allows the wiper to form a backward motion when the second rack section meshes with the intermittent gear, wherein the intermittent gear includes a projection that extends in the rotation direction as part of the toothless portion, and, after one of the two rack sections disengages from the teeth portion, the projection comes into contact with the one rack section before the teeth portion engages with the other rack section.

2. The maintenance device according to claim 1, wherein the intermittent gear moves away from the one rack section at a timing when the teeth portion starts to engage with the other rack section.

3. The maintenance device according to claim 1, wherein the rack section includes a first engaging part located on a downstream end in a moving direction of the double rack member, and a second engaging part located adjacent to the first engaging part in the moving direction, the teeth portion of the intermittent gear includes a first tooth that engages with the first engaging part and a second tooth that engages with the second engaging part, and the second engaging part is disposed at a position which does not mesh with the first tooth when the intermittent gear meshes with the rack section.

4. The maintenance device according to claim 1, further comprising:

a composite gear which includes a small diameter gear and a large diameter gear having a larger number of teeth than the small diameter gear; and a long rack member which includes a long rack section that is configured to mesh with the large diameter gear and which holds the wiper, wherein the double rack member includes a short rack section that is configured to mesh with the small diameter gear.

5. A liquid ejecting apparatus comprising:

a liquid ejecting unit that is configured to eject liquid; and the maintenance device according to claim 1.

6. A maintenance device comprising:

a wiper that wipes a liquid ejecting unit;

a double rack member which includes a pair of rack sections made up of a first rack section and a second rack section and is configured to reciprocate the wiper;

an intermittent gear which includes a teeth portion which meshes with one of two paired rack sections during rotation in one direction and a toothless portion which is arranged in line with the teeth portion in a rotation direction, wherein the double rack member allows the wiper to perform a forward motion when the first rack section meshes with the intermittent gear, and allows the wiper to perform a backward motion when the second rack section meshes with the intermittent gear;

a composite gear which includes a small diameter gear and a large diameter gear having a larger number of teeth than the small diameter gear; and a long rack member which includes a long rack section that is configured to mesh with the large diameter gear and which holds the wiper, wherein the double rack member includes a short rack section that is configured to mesh with the small diameter gear.

* * * * *